US008641836B2

(12) United States Patent
Ishikawa et al.

(10) Patent No.: US 8,641,836 B2
(45) Date of Patent: Feb. 4, 2014

(54) STEEL PLATE FOR LINE PIPE EXCELLENT IN STRENGTH AND DUCTILITY AND METHOD OF PRODUCTION OF SAME

(75) Inventors: Hajime Ishikawa, Tokyo (JP); Ryuji Uemori, Tokyo (JP); Yoshiyuki Watanabe, Tokyo (JP); Nobuhiko Mamada, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 22 days.

(21) Appl. No.: 13/138,310

(22) PCT Filed: Oct. 28, 2009

(86) PCT No.: PCT/JP2009/068858

§ 371 (c)(1),
(2), (4) Date: Jul. 28, 2011

(87) PCT Pub. No.: WO2011/052095

PCT Pub. Date: May 5, 2011

(65) Prior Publication Data

US 2012/0031532 A1 Feb. 9, 2012

(51) Int. Cl.

| | |
|---|---|
| ***C22C 38/00*** | (2006.01) |
| ***C21D 8/02*** | (2006.01) |
| ***C21D 8/04*** | (2006.01) |
| ***C22C 38/04*** | (2006.01) |
| ***C22C 38/12*** | (2006.01) |

(52) U.S. Cl.
USPC ..... 148/320; 148/541; 148/546; 420/120; 420/127

(58) Field of Classification Search
USPC ..... 148/320, 330–333, 541, 546; 420/120, 420/127
See application file for complete search history.

(56) References Cited

U.S. PATENT DOCUMENTS

| | | | | |
|---|---|---|---|---|
| 6,364,967 | B1 * | 4/2002 | Yamamoto et al. | 148/320 |
| 2002/0040744 | A1 | 4/2002 | Kanisawa et al. | |
| 2009/0120541 | A1 | 5/2009 | Shimamura et al. | |

FOREIGN PATENT DOCUMENTS

| | | | |
|---|---|---|---|
| CN | 101451217 | | 6/2009 |
| JP | 56-025926 | | 4/1981 |
| JP | 56-166320 | | 12/1981 |
| JP | 62-112722 | | 5/1987 |
| JP | 04-329826 | | 11/1992 |
| JP | 5-186820 | | 7/1993 |
| JP | 9-049050 | | 2/1997 |
| JP | 10-176240 | | 6/1998 |
| JP | 11092858 | A * | 4/1999 |
| JP | 2000-045042 | | 2/2000 |
| JP | 2000-273571 | | 10/2000 |
| JP | 2001-003136 | | 1/2001 |
| JP | 2001-020032 | | 1/2001 |
| JP | 2001-288512 | | 10/2001 |
| JP | 2003-253331 | | 9/2003 |
| JP | 2006-063351 | | 3/2006 |
| JP | 2007-146230 | | 6/2007 |
| JP | 2009-209443 | | 9/2009 |
| KR | 10-2007-0094846 | | 9/2007 |
| KR | 10-2008-0036476 | | 4/2008 |

OTHER PUBLICATIONS

Ishikawa et al., English machine translation of JP 11-092858, Apr. 6, 1999, whole document.*
Korean Office Action dated Aug. 19, 2011 issued in corresponding Korean Application No. 10-2010-7019195.
Canadian Office Action dated Jan. 20, 2012, issued in corresponding Canadian Application No. 2,756,409.
International Search Report dated Feb. 9, 2010 issued in corresponding PCT Application No. PCT/JP2009/068858.
European Search Report, dated Jul. 25, 2012, issued in corresponding European Application No. 09850874.
Chinese Office Action dated Sep. 25, 2012 issued in corresponding Chinese Application No. 200980107234.3.

* cited by examiner

*Primary Examiner* — Roy King
*Assistant Examiner* — Caitlin Kiechle
(74) *Attorney, Agent, or Firm* — Kenyon & Kenyon LLP

(57) ABSTRACT

The present invention provides steel plate for line pipe excellent in strength and ductility and a method of production of the same. The steel plate has a steel composition containing, by mass %, C: 0.04 to 0.15%, Si: 0.05 to 0.60%, Mn: 0.80 to 1.80%, P: 0.020% or less, S: 0.010% or less, Nb: 0.01 to 0.08%, and Al: 0.003 to 0.08%, having a balance of iron and unavoidable impurities, and having a value of Ceq shown by the following formula <1> of 0.48 or less, comprised of a mixed structure of ferrite and pearlite or ferrite and pearlite partially containing bainite in which a ferrite percentage is 60 to 95%, having a yield strength of 450 MPa or more, and having an amount of hydrogen contained in the steel of 0.1 ppm or less:

$$Ceq=C+Mn/6+(Cu+Ni)/15+(Cr+Mo+Nb+V+Ti)/5+5B \quad <1>.$$

4 Claims, 1 Drawing Sheet

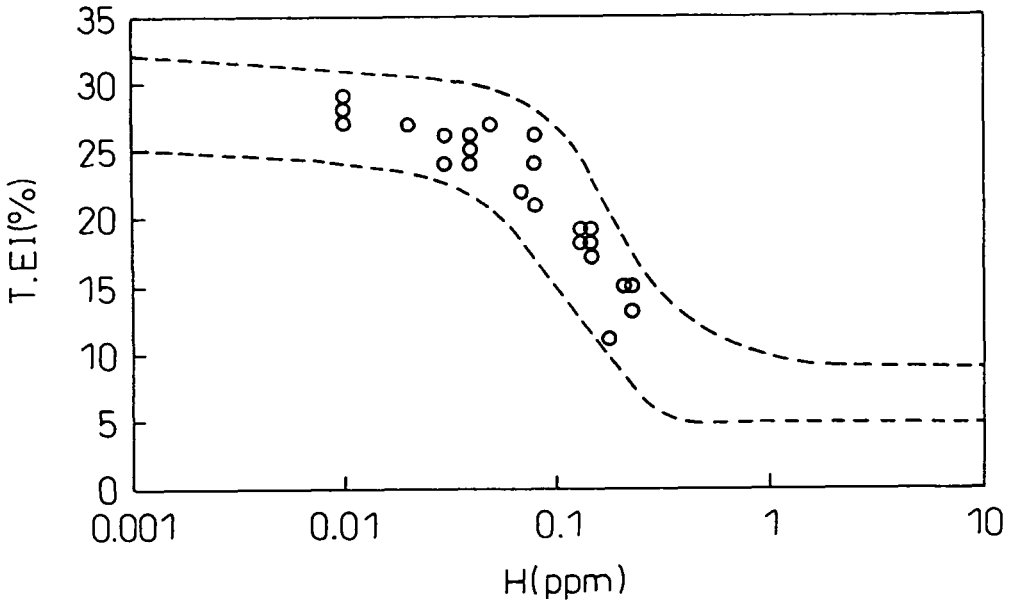
35
30
25
20
15
10
5
0
T.EI(%)
0.001
0.01
0.1
1
10
H(ppm)

STEEL PLATE FOR LINE PIPE EXCELLENT IN STRENGTH AND DUCTILITY AND METHOD OF PRODUCTION OF SAME

This application is a national stage application of International Application No. PCT/JP2009/068858, filed 28 Oct. 2009, which is incorporated by reference in its entirety.

TECHNICAL FIELD

The present invention relates to high toughness, high strength, and high ductility steel plate for line pipe having sufficient strength as steel plate for welded structures, excellent in ductility characteristics, and excellent in low temperature toughness and a method of production of the same, in particular relates to steel plate for line pipe excellent in strength and ductility for use in cold locations where low temperature toughness is demanded and a method of production of the same.

BACKGROUND ART

In recent years, steel for line pipe has been required to be improved in strength so as to improve safety, raise the pressure of transported gas and thereby improve operating efficiency, and reduce the steel materials used so as to lower costs. Further, the regions in which such steel materials are being used are spreading to artic regions and other regions where the natural environment is harsh. Strict toughness characteristics are being required. Further, in steel for structures used in earthquake prone areas etc., in addition to the conventionally required characteristics, plastic deformation ability, ductile fracture resistance characteristics, etc. are sought.

For example, PLT 1 proposes steel suppressing ductile fracture by raising the uniform elongation. It uses the quenching, lamellarizing, and tempering process (QLT process) to mix a suitable amount of hardened phases in the ferrite to obtain a mixed structure and realize a high ductility. Further, PLT 2 realizes high ductility by optimization of the steel composition and quench hardenability (Di) and by accelerated cooling.

In general, in high strength steel, raising the carbon equivalent and hardenability index is considered necessary. However, when simply raising the carbon equivalent, a drop in the ductility and toughness is invited. On the other hand, with steel plate for large-size line pipe, it is required to reduce the variations in strength, ductility, etc. in the plate so as to manage the ductility after pipemaking such as UOE, JCOE, etc.

CITATION LIST

PLT

PLT 1: Japanese Patent Publication (A) No. 2003-253331
PLT 2: Japanese Patent Publication (A) No. 2003-288512

SUMMARY OF INVENTION

Technical Problem

In steel plate for large-size line pipe, it is required to reduce the variations in strength, ductility, etc. in the plate so as to manage the ductility after pipemaking such as UOE, JCOE, etc. For this reason, for example, the technique is employed of reducing the variation in the plate by formation of a uniform structure by a QLT process. However, the QLT process involves heat treatment at a high temperature three or more times, so is not suitable as inexpensive art. Further, it is possible to achieve a high strength and high ductility by accelerated cooling corresponding to lamellarizing, but it is extremely difficult to achieve uniform cooling in the plate due to the accelerated cooling.

Therefore, the present invention has as its object the provision of inexpensive high strength steel plate excellent in toughness and ductility characteristics in steel plate for line pipe and a method of production of the same.

Solution to Problem

In general, for increasing the strength, addition of a large amount of alloys or accelerated cooling is effective, but the structure becomes high in hardenability, so conversely this degrades the ductility. Therefore, the inventors engaged in detailed research on the effects of the structure on the ductility, investigated the effects of alloy elements and structure on the strength and ductility of the base material, and clarified that the following are necessary.

(a) From the viewpoint of the strength and ductility balance, a mixed structure of ferrite and pearlite or ferrite and pearlite partially including bainite is necessary.

(b) Suitable addition of Nb, by forming a solid solution, secures strength and inhibits a drop in ductility. However, if adding too much, precipitates of this element cause the local elongation to remarkably fall. Therefore, the total elongation also ends up being caused to fall. Therefore, the amount of addition has to be defined.

(c) If adding an alloy element, the strength can be increased, but the ductility falls. For this reason, defining a suitable upper limit by the carbon equivalent is necessary.

(d) As explained above, in general, a material for steel plate for line pipe raised to a high strength ends up with a low ductility. For example, when using accelerated cooling to obtain a bainite single-phase structure, securing 600 MPa or so strength is easy. However, regarding the ductility, in particular the local elongation remarkably falls and securing a strength and ductility balance is difficult. Further, when making a structure a single phase of ferrite, obtaining a high ductility is possible, but securing strength is difficult. For this reason, a mixed structure of ferrite for raising the ductility and pearlite or pearlite partially containing bainite for securing the strength becomes required.

Based on the above discoveries, in the present invention, the inventors focused on use of inexpensive materials and controlled the structure to a mixed one of ferrite and pearlite or pearlite partially containing bainite so as to secure both strength and ductility and thereby completed the present invention.

Further, in general, it is known that if making steel high in strength, it becomes higher in sensitivity to hydrogen embrittlement. In an environment where hydrogen is continuously charged such as with stress corrosion, it is known that a simultaneous drop in strength and ductility is invited. On the other hand, in the case of the present steel plate, when reheating the plate for austenization, an amount of hydrogen greater than the amount of solute hydrogen of $\alpha$-Fe is stored. The stored hydrogen is reduced in the subsequent rolling step or cooling step, so the amount of hydrogen in an environment continuously charged with hydrogen becomes smaller and a phenomenon of embrittlement causing a drop in the strength will not occur.

However, the inventors discovered that even just a little hydrogen will cause the elongation to drop and make it difficult to secure a strength and ductility balance. There are few examples of studies of the drop in elongation characteristics arising due to such slight hydrogen. The reason why the generally known behavior of hydrogen, other than hydrogen embrittlement, causing a drop in strength has become clear is mostly that it has recently become possible to analyze hydrogen with a high precision by a simple method. The inventors, as shown in FIG. 1, clarified the relationship between the ductility of steel and the amount of hydrogen in steel. In the present invention, a total elongation of about 20% or more is aimed at. For this reason, it is learned that it is at least necessary to reduce hydrogen to 0.1 ppm or less. Note that, in general, the total elongation is expressed as the sum of the uniform elongation and local elongation. The present invention does not divide the total elongation into uniform elongation and local elongation in referring to the effects of the slight amount of hydrogen. While qualitative, if the amount of hydrogen becomes greater, the uniform elongation is affected, while if it becomes lower, the effect on the local elongation becomes greater as a general trend.

The gist of the present invention is as follows:

(1) Steel plate for line pipe excellent in strength and ductility having a steel composition containing, by mass %, C: 0.04 to 0.15%,
Si: 0.05 to 0.60%,
Mn: 0.80 to 1.80%,
P: 0.020% or less,
S: 0.010% or less,
Nb: 0.01 to 0.08%, and
Al: 0.003 to 0.08%, having a balance of iron and unavoidable impurities, and having a value of Ceq shown by the following formula <1> of 0.48 or less, comprised of a mixed structure of ferrite and pearlite or ferrite and pearlite partially containing bainite in which a ferrite percentage is 60 to 95%, having a yield strength of 450 MPa or more, and having an amount of hydrogen contained in the steel of 0.1 ppm or less:

$$Ceq=C+Mn/6+(Cu+Ni)/15+(Cr+Mo+Nb+V+Ti)/5+5B \quad <1>$$

(2) Steel plate for line pipe excellent in strength and ductility as set forth in (1), characterized in that said steel further contains, by mass %, one or more of Cu: 0.05 to 0.70%,
Ni: 0.05 to 0.70%,
Cr: 0.80% or less,
Mo: 0.30% or less,
B: 0.0003 to 0.0030%,
V: 0.01 to 0.12%,
Ti: 0.003 to 0.030%,
N: 0.0010 to 0.0100%,
Ca: 0.0005 to 0.0050%,
Mg: 0.0003 to 0.0030%, and
REM: 0.0005 to 0.0050%.

(3) A method for production of steel plate for line pipe excellent in strength and ductility characterized by continuously casting molten steel having a composition of either of (1) or (2) to obtain a cast slab, reheating said cast slab to 950 to 1250° C. in temperature region, then hot rolling at a temperature region of 850° C. or less by a cumulative reduction rate of 40% or more, ending the hot rolling in a 700 to 750° C. temperature region, then air cooling down to 350° C. or less, then slow cooling at a 300 to 100° C. temperature range for 10 hours or more or a 200 to 80° C. temperature range for 100 hours or more.

(4) A method for production of steel plate for line pipe excellent in strength and ductility characterized by continuously casting molten steel having a composition of either of (1) or (2) to obtain a cast slab, reheating said cast slab to 950 to 1250° C. in temperature region, then hot rolling at a temperature region of 850° C. or less by a cumulative reduction rate of 40% or more, ending the hot rolling in a 700 to 750° C. temperature region, then cooling down to 100° C. or less, then reheating the steel plate to 250 to 300° C. in temperature range, holding it at that temperature region for 1 minute or more, then cooling.

Advantageous Effects of Invention

According to the present invention, inexpensive steel plate for line pipe excellent in both strength and ductility is obtained, so the invention is extremely useful in industry.

BRIEF DESCRIPTION OF DRAWINGS

FIG. 1 is a view showing the relationship of the ductility of steel and the amount of hydrogen in the steel in the present invention.

DESCRIPTION OF EMBODIMENTS

Below, the present invention will be explained in detail.

In the present invention, production of high strength, high ductility UOE or JCOE steel pipe for use as mainly a steel material for welded line pipe becomes possible. In the present invention, in the steel plate, the composite characteristics of strength, toughness, and ductility required in line pipe are mainly secured by the mixed structure of ferrite and pearlite or pearlite partially containing bainite.

First, the reasons for limitation of the chemical composition of the steel plate for line pipe excellent in strength and ductility of the present invention will be explained. Note that, the % of the chemical composition indicates mass % unless particularly indicated otherwise.

(C: 0.04 to 0.15%)

C is an element required for securing strength. 0.04% or more has to be added, but addition of a large amount will cause a drop in the ductility or low temperature toughness of the base material or have a detrimental effect on the HAZ toughness, so the upper limit value is made 0.15%. To stably secure strength, it is also possible to set the lower limit of C to 0.05% or 0.06%. To improve the ductility or low temperature toughness of the base material or the HAZ toughness, the upper limit of C may be set to 0.12%, 0.10%, or 0.09%.

(Si: 0.05 to 0.60%)

Si is a deoxidizing element and an element effective for increasing the strength of steel by solution strengthening, but with less than 0.05% addition, these effects are not observed. Further, if adding over 0.60%, a large amount of MA (martensite austenite constituent) is formed in the structure, so the toughness deteriorates. For this reason, the amount of addition of Si is made 0.05 to 0.60%. For reliable deoxidation or for improvement of the strength, the lower limit of Si may be set to 0.10% or 0.020%. To prevent the deterioration of toughness due to the formation of MA, the upper limit of Si may be set to 0.50%, 0.40%, or 0.30%.

(Mn: 0.80 to 1.80%)

Mn is an element effective for raising strength so as to increase the strength of the steel. For this reason, 0.80% or more has to be added. However, if over 1.80%, center segregation etc. causes a drop in the toughness or ductility of the base material. For this reason, the suitable range of the amount of addition of Mn is defined as 0.80 to 1.80%. To stably secure strength, the lower limit of Mn may be set to 0.90%, 1.00%, or 1.10%. To avoid a drop in the toughness or ductility of the base material, the upper limit of Mn may be set to 1.60% or 1.50%.

(P: 0.020% or less)

P is contained in steel as an impurity. If becoming over 0.020%, it segregates at the grain boundaries and causes remarkable deterioration of the steel toughness. For this reason, the upper limit of the amount of addition is made 0.020%. Note that, from the viewpoint of the drop of the toughness value, this is preferably reduced as much as possible. It may be limited to 0.015% or less or 0.010% or less.

(S: 0.010% or less)

S is contained in steel as an impurity. It forms MnS and remains present in the steel and has the action of making the structure after rolling and cooling finer. However, if over 0.010%, it causes deterioration of the toughness of the base material and weld zone. For this reason, S is made 0.010% or less. To improve the toughness of the base material and weld zone, it may be limited to 0.006% or less or 0.003% or less.

(Nb: 0.01 to 0.08%)

Nb exhibits an effect of raising the strength by increasing the fineness of the austenite grains at the time of heating during reheating the slab and quenching. For this reason, 0.01% or more has to be added. However, excessive Nb addition causes an increase in Nb precipitates and causes a drop in the ductility of the base material, so the upper limit of the amount of addition of Nb is made 0.08%. To secure strength, the lower limit of the amount of addition of Nb may be set to 0.02%. To improve the ductility of the base material, the upper limit of the amount of addition of Nb may be set to 0.06% or 0.04%.

(Al: 0.003 to 0.08%)

Al is an element required for deoxidation. Its lower limit is 0.003%. If less than that, it has no effect. On the other hand, over 0.08% excessive addition causes the weldability to drop. In particular, this is remarkable in SAW using flux etc. It causes deterioration of the toughness of the weld metal. The HAZ toughness also drops. For this reason, the upper limit of Al is made 0.08%. For deoxidation, the lower limit of Al may also be set to 0.005% or 0.010%. To improve the toughness of the weld metal and HAZ, the upper limit of Al may also be limited to 0.05% or 0.04%.

The basic composition of the steel plate of the present invention is as explained above. Due to this, the required target values can be sufficiently achieved. However, for further improving the properties, if necessary, one or more of the following elements may be added as optional elements.

(Cu: 0.05 to 0.70%)

Cu is an element effective for achieving high strength. To secure the effect of precipitation hardening by Cu, 0.05% or more has to be added. However, excessive addition causes the base material to rise in hardness and fall in ductility, so the upper limit is made 0.70%. To further improve the ductility, the upper limit of Cu may be set to 0.50%, 0.30%, or 0.20%.

(Ni: 0.05 to 0.70%)

Ni has the effects of raising the strength and toughness and also preventing Cu Cracking without Having a detrimental effect on the weldability etc. To obtain these effects, 0.05% or more has to be added. However, Ni is expensive, so if 0.70% or more is added, the steel can no longer be produced inexpensively, so the content is made 0.70% or less. To reduce the costs, the upper limit of Ni may be set to 0.50%, 0.30%, or 0.20%.

(Cr: 0.80% or Less)

Cr is an element for raising the strength of the base material. However, if over 0.80%, the base material is raised in hardness and the ductility is made to deteriorate. For this reason, the upper limit value is made 0.80%. Note that, in the present invention, no lower limit value of Cr is defined. Preferably, to secure strength, 0.05% or more is added. To improve the ductility, the upper limit of Cr may be set to 0.50%, 0.30%, or 0.20%.

(Mo: 0.30% or Less)

Mo, like Cr, is an element for raising the strength of the base material. However, if over 0.30%, it causes the hardness of the base material to rise and causes the ductility to deteriorate. For this reason, the upper limit value is made 0.50%. Note that, in the present invention, the lower limit value of Mo is not defined. Preferably, to secure strength, 0.05% or more is added. To improve the ductility, the upper limit of Mo may be set to 0.25% or 0.15%.

(B: 0.0003 to 0.0030%)

B is an element forming a solid solution in steel to raise the hardenability and increase the strength. To obtain this effect, addition of 0.0003% or more is necessary. However, if adding B in excess, the base material toughness is made to fall, so the upper limit value is made 0.0030%. To improve the base material toughness, the upper limit of B may be set to 0.0020% or 0.0015%.

(V: 0.01 to 0.12%)

V has an Action Substantially the Same as Nb, but compared with Nb, the effect is small. To obtain a similar effect as with Nb, less than 0.01% is insufficient. However, if over 0.12%, the ductility deteriorates. For this reason, the suitable range of the amount of addition of V is made 0.01 to 0.12%. To improve the ductility, the upper limit of V may be set to 0.11%, 0.07%, or 0.06%.

(Ti: 0.005 to 0.030%)

Ti bonds with N to form TiN in the steel which is effective for raising the strength and ductility. For this, 0.005% or more is desirably added. However, if adding over 0.030% of Ti, this is liable to cause the TiN to coarsen and cause the base material to fall in ductility. For this reason, Ti is made 0.005 to 0.030% in range. To improve the ductility of the base material, the upper limit of Ti may be set at 0.020% or 0.015%.

(N: 0.0010 to 0.0100%)

N bonds with Ti to form TiN in the steel which is effective for raising the strength and ductility. For this, 0.0010% or more has to be added. However, N also has an extremely great effect as a solution strengthening element, so if adding this in a large amount, it is liable to degrade the ductility. For this reason, to enable the advantageous effect of TiN to be obtained to the maximum extent without having a major effect on the ductility, the upper limit of N is made 0.0100%.

(Ca: 0.0005 to 0.0050%)

Ca has the effect of controlling the form of the sulfides (MnS), increasing the Charpy absorption energy, and improving the low temperature toughness. For this reason, 0.0005% or more has to be added. However, if over 0.0050%, coarse CaO or CaS is formed in large amounts and the toughness of the steel is adversely affected, so a 0.0050% upper limit was set.

(Mg: 0.0003 to 0.0030%)

Mg has the action of inhibiting the growth of austenite grains and maintaining fine grains and improves the toughness. To enjoy that effect, at least 0.0003% or more needs to be added. This amount is made the lower limit. On the other hand, even if increasing the amount of addition more, not only does the extent of the effect vis-à-vis the amount of addition become smaller, but also Mg causes poorer economy since the steelmaking yield is not necessarily that high. For this reason, the upper limit is limited to 0.0030%.

(REM: 0.0005 to 0.0050%)

A REM, like Mg, has the action of inhibiting the growth of austenite grains and maintaining fine grains and improves the toughness. To enjoy that effect, at least 0.0005% or more needs to be added. This amount is made the lower limit. On the other hand, even if increasing the amount of addition more, not only does the extent of the effect vis-à-vis the amount of addition become smaller, but also Mg causes poorer economy since the steel making yield is not necessarily that high. For this reason, the upper limit is limited to 0.0050%.

In the present invention, it is necessary to make the chemical composition of the steel the above range and, further, make the value of Ceq, shown by the following formula <1>, 0.48 or less.

$$Ceq=C+Mn/6+(Cu+Ni)/15+(Cr+Mo+Nb+V+Ti)/5+5B \quad <1>$$

The above formula <1> is a formula showing the carbon equivalent of steel. To secure the base material strength, addition of elements of the above formula <1> is effective. However, an excessive amount of addition hardens the base material structure and causes deterioration of the ductility. For this reason, the carbon equivalent Ceq has to be made at least 0.48 or less. To secure strength, the lower limit of Ceq may be set to 0.30% or 0.33%. To secure high ductility, to make the structure mainly ferrite (to raise the ferrite percentage higher), the upper limit of Ceq may be set to 0.43%, 0.40%, or 0.38%.

The yield strength in the steel plate of the present invention is made 450 MPa or more, but it may also be limited to 490 MPa or 550 MPa.

Next, the limitation of the amount of hydrogen in the steel plate in the present invention will be explained.

In general, it is known that increase of the hydrogen embrittles steel. The concentration of hydrogen in the steel and trap sites are difficult to simultaneously accurately measure. Much research is under way. The inventors uses gas chromatography and limited the test size and temperature elevation rate to throw light on the relationship between the amount of hydrogen and the elongation.

For example, it is known that the increase of hydrogen in steel causes the limit strength in the material strength to drop like with delayed fracture etc. At this time, the ductility, in particular, the uniform elongation, also falls. For delayed fracture, development of steel materials with large limit amounts of hydrogen leading to hydrogen embrittlement fracture of the steel material for the invading hydrogen is being studied.

In the present invention as well, in the same way as delayed fracture, if the amount of hydrogen in the steel exceeds about 1 ppm, at the time of a tensile test, it was confirmed there was a trend for hydrogen embrittlement to promote fracture and for the elongation and strength to fall. On the other hand, even with an amount of hydrogen lower than 1 ppm, the strength will not fall—only the elongation will fall. To secure a total elongation of about 20% or more, it is necessary to lower the hydrogen in the steel to 0.1 ppm or less. To improve the elongation more, the hydrogen in the steel may be limited to 0.07 ppm, 0.05 ppm, or 0.03 ppm or less.

In the steel plate of the present invention, as the structure, as explained above, a mixed structure of ferrite and pearlite or pearlite partially containing bainite is necessary.

Further, in this mixed structure, if the ferrite percentage exceeds 95%, securing the strength is difficult. Further, if the ferrite percentage becomes less than 60%, the ductility and the toughness fall. For this reason, the ferrite percentage is made 60 to 95%. To secure the strength, the upper limit of the ferrite percentage may be set to 90% or less. To improve the ductility and toughness, the lower limit of the ferrite percentage may be set to 65% or 70%.

Note that, the main structure in the steel plate of the present invention is a mixed structure of ferrite and pearlite or pearlite partially containing bainite, but the presence of 1% or less of MA or residual austenite is confirmed.

Next, the method of production of the steel plate of the present invention will be explained.

The method of production of the steel plate for line pipe excellent in strength and ductility of the present invention comprises continuously casting steel to obtain a cast slab, reheating said cast slab to 950 to 1250° C. in temperature region, then hot rolling at a temperature region of 850° C. or less by a cumulative reduction rate of 40% or more, ending the hot rolling in a 700 to 750° C. temperature region, then 1) air cooling down to 350° C. or less, then slow cooling at a 300 to 100° C. temperature range for 10 hours or more or a 200 to 80° C. temperature range for 100 hours or more or 2) ending the hot rolling, then cooling down to 100° C. or less, then reheating the steel plate to 250 to 300° C. in temperature range, holding it at that temperature region for 1 minute or more, then cooling.

The reason for limiting the production conditions of the steel material of the present invention in the above way is as follows.

The cast slab is reheated to a temperature in the 950 to 1250° C. temperature region because if the reheating temperature exceeds 1250° C., the coarsening of the crystal grain size becomes remarkable and, further, the heating causes scale to be formed on the steel surface in large amounts and the quality of the surface to remarkably fall. Further, if less than 950° C., the Nb or the optionally added V etc. will not form a solid solution again much at all and the elements added for improving strength etc. will fail to perform their roles, so will become industrially meaningless. For this reason, the range of the reheating temperature is made 950 to 1250° C.

The steel is hot rolled in the 850° C. or less temperature region by a cumulative reduction rate of 40% or more because an increase of the amount of reduction in the non-recrystallization temperature region of the 850° C. or less temperature region or less contributes to the increased fineness of the austenite grains during rolling and as a result has the effect of making the ferrite grains finer and improving the mechanical properties. To obtain such an advantageous effect, the cumulative reduction rate in the 850° C. or less temperature region has to be 40% or more. For this reason, in the 850° C. or less temperature region, the cumulative reduction amount is made 40% or more.

The steel slab then has to be finished being hot rolled in the 700 to 750° C. temperature region, then air-cooled to 350° C. or less, then slow cooled at a 300 to 100° C. temperature range for 10 hours or more or a 200 to 80° C. temperature range for 100 hours or more or finished being hot rolled in the 700 to 750° C. temperature region, then cooled to 100° C. or less, then the steel plate reheated to a 250 to 300° C. temperature range, held at that temperature region for 1 minute or more, then cooled.

In the present invention, the steel is rolled in the 750 to 700° C. dual-phase temperature region to cause the appearance of a mixed structure of ferrite and pearlite (or pearlite partially containing bainite) and obtain DWTT or other base material toughness and high strength and a high ductility.

If the rolling end temperature exceeds 750° C., a band-like pearlite structure is not formed, so to improve the base material toughness, the temperature has to be made 750° C. or less.

Further, if becoming less than 700° C., the amount of worked ferrite increases and causes the ductility to fall.

In the present invention, to obtain a steel plate with high ductility, the inside of the steel plate has to be uniformly cooled. If using general accelerated cooling, in the cooling process, due to the effects of the plate thickness etc., the cooling inside the steel plate becomes uneven. For this reason, in the present invention, air cooling is used and the cooling speed is not limited. However, since the pearlite, bainite, and other secondary phase structures would end up with island shaped martensite (MA) formed in them resulting in lowered toughness, the speed is preferably 5° C./s or less.

In the present invention, as explained above, to improve the ductility, the hydrogen in the steel is made 0.1 ppm or less. For this reason, a dehydrogenation operation is performed. First, as one method, there is the method of finishing the hot rolling, then air-cooling to 350° C. or less, then slow cooling in a 300 to 100° C. temperature range for 10 hours or more or in a 200 to 80° C. temperature range for 100 hours or more. If starting the slow cooling over a 350° C. temperature, the effect of the tempering would cause the strength to remarkably drop, so the steel is air cooled down to 350° C. or less. Regarding the later slow cooling, unless maintaining the 300 to 100° C. temperature range for 10 hours or more or the 200 to 80° C. temperature range for 100 hours or more, the amount of hydrogen in the steel will not fall to 0.1 ppm or less and securing elongation will become difficult. In general, hydrogen becomes more difficult to remove from steel the lower the temperature is made. For example, in the case of a, plate thickness of 25 mm, at 45° C. or so, about 780 hours are required, so this is not suitable industrially. As an ironmaking process for such slow cooling, for example, the method of loading the steel plate into a heating furnace and slowing cooling it while controlling the cooling speed, stacked slow cooling stacking a large number of 350° C. or less warm steel plates for gradually cooling, etc. may be mentioned.

As another method, there is the method of ending the hot rolling, then air-cooling to 100° C. or less, then reheating the steel plate to 250 to 300° C. in temperature range, holding it at that temperature region for 1 minute or more, then cooling.

Note that if not air-cooling once to 100° C. or less, a predetermined strength is not obtained. On top of that, the steel is tempered in the 250 to 300° C. temperature region for 1 minute or more. If reheating to a temperature over 300° C., the effect of the tempering will cause the strength to remarkably fall. Further, performing the tempering and dehydrogenation at a temperature lower than 250° C. would be effective in reducing the amount of hydrogen in the steel, but a longer holding time would become necessary, so the steel would become less economical. The holding time in the present invention is 1 minute or more. If made less than this, the dehydrogenation would become insufficient.

EXAMPLES

Next, examples of the present invention will be explained.

Molten steel having each of the chemical compositions of Table 1 was continuously cast. The slab was hot rolled under the conditions shown in Table 2 to obtain steel plate which was then tested to evaluate its mechanical properties. For the tensile test pieces, GOST test pieces of the Russian standard were taken each steel plate and evaluated for YS (0.5% underload), TS, and total elongation (T. El). The base material toughness was evaluated by a DWTT test by the −20° C. ductility shear area (SA). For the amount of hydrogen, a gas chromatograph was used, a rod of 5 mmϕ×100 mm was cut out from the steel plate at ½t, and the temperature elevation method (temperature elevation speed of 100° C./hr) was used to find the amount of diffusible hydrogen released in the 50 to 200° C. temperature range. Further, the ferrite percentage was calculated by an image processor classifying the ferrite and secondary phase structures (structures other than ferrite such as pearlite or bainite) in 10 fields of a 500× optical micrograph.

TABLE 1

| Steel | C | Si | Mn | P | S | Nb | Al | Cu | Ni | Cr | Mo |
|---|---|---|---|---|---|---|---|---|---|---|---|
| 1 | 0.05 | 0.32 | 1.30 | 0.006 | 0.0014 | 0.025 | 0.004 | 0.00 | 0.00 | 0.00 | 0.25 |
| 2 | 0.14 | 0.06 | 1.40 | 0.006 | 0.0014 | 0.012 | 0.004 | 0.00 | 0.00 | 0.00 | 0.00 |
| 3 | 0.09 | 0.23 | 1.25 | 0.001 | 0.0005 | 0.023 | 0.010 | 0.00 | 0.00 | 0.10 | 0.00 |
| 4 | 0.07 | 0.55 | 1.25 | 0.006 | 0.0021 | 0.029 | 0.033 | 0.00 | 0.00 | 0.00 | 0.09 |
| 5 | 0.10 | 0.43 | 0.85 | 0.001 | 0.0011 | 0.023 | 0.005 | 0.00 | 0.00 | 0.00 | 0.00 |
| 6 | 0.12 | 0.25 | 1.75 | 0.001 | 0.0010 | 0.023 | 0.021 | 0.00 | 0.00 | 0.00 | 0.00 |
| 7 | 0.08 | 0.33 | 1.20 | 0.000 | 0.0009 | 0.022 | 0.011 | 0.00 | 0.00 | 0.00 | 0.14 |
| 8 | 0.10 | 0.47 | 1.46 | 0.006 | 0.0022 | 0.038 | 0.035 | 0.00 | 0.00 | 0.00 | 0.09 |
| 9 | 0.10 | 0.41 | 1.46 | 0.010 | 0.0019 | 0.029 | 0.038 | 0.00 | 0.00 | 0.00 | 0.08 |
| 10 | 0.10 | 0.45 | 1.01 | 0.006 | 0.0021 | 0.040 | 0.034 | 0.00 | 0.00 | 0.00 | 0.09 |
| 11 | 0.11 | 0.29 | 1.14 | 0.018 | 0.0058 | 0.025 | 0.025 | 0.00 | 0.00 | 0.00 | 0.00 |
| 12 | 0.14 | 0.10 | 0.90 | 0.001 | 0.0005 | 0.025 | 0.010 | 0.00 | 0.00 | 0.00 | 0.05 |
| 13 | 0.12 | 0.45 | 1.62 | 0.009 | 0.0082 | 0.036 | 0.029 | 0.00 | 0.00 | 0.10 | 0.00 |
| 14 | 0.12 | 0.53 | 0.90 | 0.006 | 0.0005 | 0.076 | 0.010 | 0.00 | 0.25 | 0.00 | 0.00 |
| 15 | 0.13 | 0.16 | 0.85 | 0.006 | 0.0014 | 0.056 | 0.006 | 0.15 | 0.05 | 0.00 | 0.00 |
| 16 | 0.03 | 0.33 | 0.90 | 0.006 | 0.0005 | 0.030 | 0.010 | 0.00 | 0.00 | 0.00 | 0.00 |
| 17 | 0.19 | 0.33 | 1.20 | 0.006 | 0.0009 | 0.022 | 0.011 | 0.00 | 0.00 | 0.00 | 0.14 |
| 18 | 0.11 | 0.02 | 1.21 | 0.006 | 0.0009 | 0.022 | 0.004 | 0.00 | 0.00 | 0.00 | 0.14 |
| 19 | 0.10 | 0.65 | 1.45 | 0.006 | 0.0018 | 0.035 | 0.010 | 0.00 | 0.00 | 0.00 | 0.00 |
| 20 | 0.09 | 0.33 | 0.41 | 0.006 | 0.0009 | 0.022 | 0.011 | 0.00 | 0.00 | 0.00 | 0.14 |
| 21 | 0.10 | 0.33 | 1.92 | 0.007 | 0.0020 | 0.031 | 0.002 | 0.00 | 0.00 | 0.00 | 0.31 |
| 22 | 0.10 | 0.37 | 1.70 | 0.006 | 0.0018 | 0.015 | 0.010 | 0.00 | 0.00 | 0.00 | 0.00 |
| 23 | 0.10 | 0.38 | 1.35 | 0.005 | 0.0011 | 0.098 | 0.015 | 0.00 | 0.00 | 0.00 | 0.00 |

| Steel | V | Ti | Mg | Ca | REM | B | N | Ceq |
|---|---|---|---|---|---|---|---|---|
| 1 | 0.058 | 0.011 | 0.0000 | 0.0000 | 0.0000 | 0.0000 | 0.0039 | 0.34 |
| 2 | 0.015 | 0.011 | 0.0000 | 0.0000 | 0.0000 | 0.0000 | 0.0035 | 0.38 |
| 3 | 0.020 | 0.015 | 0.0000 | 0.0000 | 0.0000 | 0.0000 | 0.0013 | 0.33 |
| 4 | 0.066 | 0.011 | 0.0003 | 0.0000 | 0.0000 | 0.0000 | 0.0036 | 0.32 |
| 5 | 0.058 | 0.011 | 0.0014 | 0.0000 | 0.0000 | 0.0000 | 0.0032 | 0.26 |

TABLE 1-continued

| | | | | | | | | |
|---|---|---|---|---|---|---|---|---|
| 6 | 0.058 | 0.011 | 0.0000 | 0.0000 | 0.0000 | 0.0000 | 0.0037 | 0.43 |
| 7 | 0.110 | 0.011 | 0.0000 | 0.0000 | 0.0000 | 0.0000 | 0.0031 | 0.34 |
| 8 | 0.052 | 0.011 | 0.0000 | 0.0000 | 0.0000 | 0.0000 | 0.0037 | 0.38 |
| 9 | 0.051 | 0.011 | 0.0000 | 0.0000 | 0.0000 | 0.0000 | 0.0038 | 0.38 |
| 10 | 0.055 | 0.005 | 0.0000 | 0.0000 | 0.0005 | 0.0000 | 0.0032 | 0.31 |
| 11 | 0.058 | 0.026 | 0.0000 | 0.0015 | 0.0000 | 0.0000 | 0.0054 | 0.32 |
| 12 | 0.058 | 0.015 | 0.0000 | 0.0000 | 0.0000 | 0.0010 | 0.0030 | 0.32 |
| 13 | 0.068 | 0.012 | 0.0000 | 0.0015 | 0.0000 | 0.0000 | 0.0035 | 0.43 |
| 14 | 0.000 | 0.015 | 0.0000 | 0.0000 | 0.0000 | 0.0000 | 0.0025 | 0.30 |
| 15 | 0.000 | 0.011 | 0.0000 | 0.0000 | 0.0000 | 0.0011 | 0.0039 | 0.30 |
| 16 | 0.058 | 0.015 | 0.0000 | 0.0000 | 0.0000 | 0.0000 | 0.0030 | 0.20 |
| 17 | 0.058 | 0.011 | 0.0000 | 0.0000 | 0.0000 | 0.0000 | 0.0031 | 0.44 |
| 18 | 0.058 | 0.011 | 0.0000 | 0.0000 | 0.0000 | 0.0000 | 0.0025 | 0.36 |
| 19 | 0.058 | 0.015 | 0.0000 | 0.0000 | 0.0000 | 0.0000 | 0.0030 | 0.36 |
| 20 | 0.058 | 0.011 | 0.0000 | 0.0000 | 0.0000 | 0.0000 | 0.0031 | 0.20 |
| 21 | 0.058 | 0.002 | 0.0000 | 0.0000 | 0.0000 | 0.0000 | 0.0042 | 0.50 |
| 22 | 0.058 | 0.015 | 0.0000 | 0.0000 | 0.0000 | 0.0000 | 0.0030 | 0.40 |
| 23 | 0.058 | 0.000 | 0.0000 | 0.0000 | 0.0000 | 0.0000 | 0.0025 | 0.36 |

TABLE 2

| | | | Hot rolling | | | | Slow cooling | | Steel plate reheating | |
|---|---|---|---|---|---|---|---|---|---|---|
| | | | | 850° C. or less | | | | | | |
| | Steel plate | Steel | Reheating temp. (° C.) | cumulative reduction amount (%) | Rolling end temp. (° C.) | Air cooling stop temp. (slow cooling start temp.) (° C.) | 300 to 100° C. region cooling time (hr) | 200 to 80° C. region cooling time (hr) | Heating temp. (° C.) | Holding time (min) |
| Inv. steel | a | 1 | 1150 | 45 | 700 | 330 | 10 | — | None | None |
| Inv. steel | b | 2 | 1150 | 45 | 750 | 350 | 20 | — | None | None |
| Inv. steel | c | 3 | 1150 | 45 | 740 | 350 | 20 | — | None | None |
| Inv. steel | d | 4 | 1250 | 60 | 700 | 350 | 15 | — | None | None |
| Inv. steel | e | 5 | 1200 | 45 | 720 | 350 | 20 | — | None | None |
| Inv. steel | f | 6 | 1150 | 45 | 720 | 250 | — | 120 | None | None |
| Inv. steel | g | 7 | 950 | 50 | 720 | 250 | — | 100 | None | None |
| Inv. steel | h | 8 | 1150 | 45 | 730 | 250 | — | 150 | None | None |
| Inv. steel | i | 9 | 1150 | 60 | 720 | 250 | — | 150 | None | None |
| Inv. steel | j | 10 | 1150 | 45 | 720 | 250 | — | 100 | None | None |
| Inv. steel | k | 11 | 1100 | 50 | 720 | 100 | None | None | 300 | 1 |
| Inv. steel | l | 12 | 1000 | 45 | 720 | 50 | None | None | 250 | 10 |
| Inv. steel | m | 13 | 1100 | 45 | 730 | Room temp. | None | None | 280 | 60 |
| Inv. steel | n | 14 | 1150 | 60 | 720 | 90 | None | None | 300 | 20 |
| Inv. steel | o | 15 | 1150 | 60 | 700 | 90 | None | None | 300 | 20 |
| Comp. steel | p | 1 | 1150 | 30 | 700 | 350 | 15 | — | None | None |
| Comp. steel | q | 2 | 1150 | 45 | 780 | 350 | 15 | — | None | None |
| Comp. steel | r | 3 | 1150 | 45 | 730 | 400 | 15 | — | None | None |
| Comp, steel | s | 4 | 1150 | 60 | 730 | 350 | 8 | — | None | None |
| Comp. steel | t | 5 | 1150 | 45 | 700 | 250 | — | 80 | None | None |
| Comp. steel | u | 6 | 1150 | 45 | 720 | 50 | None | None | 100 | 1 |
| Comp. steel | v | 7 | 1150 | 50 | 720 | Room temp. | None | None | 250 | 0.5 |
| Comp. steel | w | 8 | 1150 | 60 | 750 | (Water cooling) 350 | 15 | — | None | None |
| Comp. steel | x | 16 | 1150 | 45 | 720 | 330 | 10 | — | None | None |
| Comp. steel | y | 17 | 1150 | 45 | 730 | 330 | 10 | — | None | None |
| Comp. steel | z | 18 | 1150 | 50 | 720 | 330 | 10 | — | None | None |
| Comp. steel | aa | 19 | 1150 | 50 | 720 | 330 | 10 | — | None | None |
| Comp. steel | ab | 20 | 1150 | 50 | 720 | 330 | 10 | — | None | None |
| Comp. steel | ac | 21 | 1150 | 50 | 720 | 330 | 10 | — | None | None |
| Comp. steel | ad | 22 | 1150 | 50 | 720 | 330 | 10 | — | None | None |
| Comp. steel | ae | 23 | 1150 | 50 | 720 | 330 | 10 | — | None | None |

TABLE 3

| | Steel plate | Steel | Plate thick. (mm) | Structure | Ferrite percentage (%) | H (ppm) | YS (MPa) | TS (MPa) | T. El (%) | DWTT at −20° C. (%) |
|---|---|---|---|---|---|---|---|---|---|---|
| Inv. steel | a | 1 | 15 | F, P | 93 | <0.01 | 550 | 680 | 27 | 91 |
| Inv. steel | b | 2 | 30 | F, P, B | 75 | <0.01 | 600 | 770 | 28 | 82 |
| Inv. steel | c | 3 | 20 | F, P | 84 | 0.03 | 540 | 620 | 26 | 85 |
| Inv. steel | d | 4 | 21 | F, P, B | 80 | <0.01 | 580 | 700 | 27 | 85 |
| Inv. steel | e | 5 | 25 | F, P | 94 | 0.05 | 500 | 620 | 27 | 92 |
| Inv. steel | f | 6 | 27 | F, P, B | 72 | 0.07 | 640 | 750 | 22 | 84 |

TABLE 3-continued

| | Steel plate | Steel | Plate thick, (mm) | Structure | Ferrite percentage (%) | H (ppm) | YS (MPa) | TS (MPa) | T. El (%) | DWTT at −20° C. (%) |
|---|---|---|---|---|---|---|---|---|---|---|
| Inv. steel | g | 7 | 25 | F, P, B | 74 | 0.03 | 610 | 760 | 24 | 82 |
| Inv. steel | h | 8 | 25 | F, P, B | 73 | 0.04 | 610 | 760 | 25 | 82 |
| Inv. steel | i | 9 | 35 | F, P, B | 82 | <0.01 | 590 | 710 | 28 | 87 |
| Inv. steel | j | 10 | 30 | F, P | 85 | 0.08 | 540 | 680 | 21 | 86 |
| Inv. steel | k | 11 | 20 | F, P | 86 | 0.04 | 550 | 630 | 26 | 87 |
| Inv. steel | l | 12 | 22 | F, P, B | 66 | 0.04 | 600 | 780 | 25 | 83 |
| Inv. steel | m | 13 | 20 | F, P, B | 77 | 0.08 | 540 | 630 | 26 | 88 |
| Inv. steel | n | 14 | 20 | F, P, B | 62 | <0.01 | 620 | 730 | 29 | 82 |
| Inv. steel | o | 15 | 20 | F, P, B | 76 | 0.03 | 630 | 750 | 24 | 83 |
| Comp. steel | p | 1 | 15 | F, P | 93 | 0.03 | 500 | 640 | 24 | 62 |
| Comp. steel | q | 2 | 30 | F, P, B | 80 | 0.04 | 580 | 740 | 25 | 61 |
| Comp. steel | r | 3 | 30 | F, P | 80 | 0.04 | 440 | 510 | 24 | 82 |
| Comp. steel | s | 4 | 20 | F, P, B | 71 | 0.23 | 680 | 800 | 13 | 68 |
| Comp. steel | t | 5 | 25 | F, P | 90 | 0.21 | 510 | 630 | 15 | 82 |
| Comp. steel | u | 6 | 27 | F, P, B | 72 | 0.21 | 630 | 730 | 15 | 81 |
| Comp. steel | v | 7 | 25 | F, P, B | 72 | 0.23 | 600 | 740 | 15 | 80 |
| Comp. steel | w | 8 | 25 | F, M | 32 | 0.18 | 690 | 920 | 11 | 65 |
| Comp. steel | x | 16 | 25 | F, P | 97 | 0.02 | 340 | 450 | 30 | 93 |
| Comp. steel | y | 17 | 25 | F, P, B | 47 | 0.13 | 700 | 880 | 18 | 83 |
| Comp. steel | z | 18 | 25 | F, P | 71 | 0.13 | 540 | 630 | 19 | 80 |
| Comp. steel | aa | 19 | 25 | F, P, B | 88 | 0.15 | 550 | 650 | 17 | 82 |
| Comp. steel | ab | 20 | 25 | F, P | 58 | 0.08 | 420 | 500 | 24 | 80 |
| Comp. steel | ac | 21 | 30 | F, P, B | 53 | 0.15 | 670 | 850 | 19 | 82 |
| Comp. steel | ad | 22 | 25 | F, P | 80 | 0.15 | 550 | 630 | 18 | 62 |
| Comp. steel | ae | 23 | 25 | F, P, B | 80 | 0.07 | 650 | 790 | 19 | 65 |

F: ferrite P: pearlite B: bainite M: martensite

Table 3 shows all together the mechanical properties of the different steel plates. In the present invention, the production process, as shown in Table 2, is roughly divided into the two processes of cooling down to a predetermined air cooling stop temperature, then slow cooling for a to j and of reheating the steel plate after air cooling for k to o.

The Steel Plates a to o are examples of the present invention. As clear from Table 1 and Table 2, these steel plates satisfy all requirements of the chemical compositions and production conditions. For this reason, as shown in Table 3, in each case the tensile strength was 450 MPa or more as the base material strength, the total elongation was 20% or more as the ductility, and the ductility shear area of the DWTT characteristic (−20° C.) was 80% or more as the toughness—all good. Note that, the structures were all mixed structures of ferrite+pearlite (including partial bainite).

As opposed to this, the Steel Plates p to ae are outside the scope of the present invention, so are inferior to the present invention steels in one or more points of the mechanical properties of the base materials. In the Steel Plates p to w, the production conditions are outside the scope, while in the Steel Plates x to ae the chemical compositions are outside the scope, so these are examples where the mechanical properties fall from the present invention.

The Steel Plate p has a small cumulative reduction amount, while the Steel Plate q has a high rolling end temperature, so their structures could not be made finer and their DWTT properties dropped. With the Steel Plate r, the air cooling stop temperature is high, so the predetermined strength is not obtained.

Further, the Steel Plates s to v dropped in ductility due to the poor dehydrogenation conditions and the residual hydrogen in the steel.

The Steel Plate w employed 10° C./s or more rapid cooling, so was formed with much martensite, so the elongation fell.

The Steel Plate x is low in amount of C, so the base material strength fell. Further, the Steel Plate y is high in amount of C and remarkably high in strength, so fell in elongation. The Steel Plate z is high in amount of Si, lower in deoxidation ability, and increased in oxides, so the ductility fell. The Steel Plate aa is large in amount of Si and increased in Si-based oxides etc., so the elongation fell. The Steel Plate ab is small in the amount of Mn, so the predetermined strength cannot be obtained. The Steel Plate ac is large in the amount of Mn, so the predetermined elongation characteristics and toughness cannot be obtained. The Steel Plate ad is small in the amount of Nb, so uniform increased fineness of the structure cannot be obtained. On the other hand, the Steel Plate ae is high in the amount of Nb and greater in Nb-based precipitates, so the ductility and toughness fell.

INDUSTRIAL APPLICABILITY

According to the present invention, it is possible to provide inexpensive steel plate for line pipe excellent in both characteristics of strength and ductility, so it becomes possible to economically produce high strength, high ductility UOE steel pipe, JCOE steel pipe, etc.

The invention claimed is:

1. Steel plate for line pipe having a steel composition containing, by mass %, C: 0.07 to 0.15%,
Si: 0.05 to 0.60%,
Mn: 0.80 to 1.80%,
P: 0.020% or less,
S: 0.010% or less,
Nb: 0.01 to 0.08%, and
Al: 0.003 to 0.08%, having a balance of iron and unavoidable impurities, and having a value of Ceq shown by the following formula <1> of 0.48 or less, comprised of a mixed structure of ferrite and pearlite or ferrite and pearlite partially containing bainite in which a ferrite percentage is 60 to 95%, having a yield strength of 450 MPa or more and a total elongation of 20% or more, and having an amount of hydrogen contained in the steel of 0.1 ppm or less:

$$Ceq=C+Mn/6+(Cu+Ni)/15+(Cr+Mo+Nb+V+Ti)/5+5B \quad <1>.$$

2. Steel plate for line pipe as set forth in claim 1, characterized in that said steel further contains, by mass %, one or more of Cu: 0.05 to 0.70%,
Ni: 0.05 to 0.70%,
Cr: 0.80% or less,
Mo: 0.30% or less,
B: 0.0003 to 0.0030%,
V: 0.01 to 0.12%,
Ti: 0.003 to 0.030%,
N: 0.0010 to 0.0100%,
Ca: 0.0005 to 0.0050%,
Mg: 0.0003 to 0.0030%, and
REM: 0.0005 to 0.0050%.

3. A method for production of steel plate for line pipe characterized by continuously casting molten steel having a composition of either of claim 1 or 2 to obtain a cast slab, reheating said cast slab to 950 to 1250° C. in temperature region, then hot rolling at a temperature region of 850° C. or less by a cumulative reduction rate of 40% or more, ending the hot rolling in a 700 to 750° C. temperature region, then air cooling down to 350° C. or less, then cooling in a 300 to 100° C. temperature range for 10 hours or more or a 200 to 80° C. temperature range for 100 hours or more.

4. A method for production of steel plate for line pipe characterized by continuously casting molten steel having a composition of either of claim 1 or 2 to obtain a cast slab, reheating said cast slab to 950 to 1250° C. in temperature region, then hot rolling at a temperature region of 850° C. or less by a cumulative reduction rate of 40% or more, ending the hot rolling in a 700 to 750° C. temperature region, then cooling down to 100° C. or less, then reheating the steel plate to 250 to 300° C. temperature range, holding it at that temperature region for 1 minute or more, then cooling.

* * * * *